US009399602B2

(12) United States Patent
Williamson

(10) Patent No.: US 9,399,602 B2
(45) Date of Patent: Jul. 26, 2016

(54) PROCESSING EXPLOSIVES

(71) Applicant: ROXEL (UK ROCKET MOTORS) LIMITED, Kidderminster, Worcestershire (GB)

(72) Inventor: Matthew James Ian Williamson, Kidderminster (GB)

(73) Assignee: ROXEL (UK ROCKET MOTORS) LIMITED, Kidderminister, Worcestershire (GB)

( * ) Notice: Subject to any disclaimer, the term of this patent is extended or adjusted under 35 U.S.C. 154(b) by 0 days.

(21) Appl. No.: 14/367,983

(22) PCT Filed: Dec. 7, 2012

(86) PCT No.: PCT/GB2012/053059
§ 371 (c)(1),
(2) Date: Jun. 23, 2014

(87) PCT Pub. No.: WO2013/093419
PCT Pub. Date: Jun. 27, 2013

(65) Prior Publication Data

US 2014/0367003 A1 Dec. 18, 2014

(30) Foreign Application Priority Data

Dec. 22, 2011 (GB) ..... 1122153.8

(51) Int. Cl.
*C06B 21/00* (2006.01)
*B01F 5/04* (2006.01)
*B01F 3/08* (2006.01)

(52) U.S. Cl.
CPC ..... *C06B 21/00* (2013.01); *B01F 3/0807* (2013.01); *B01F 5/0476* (2013.01); *C06B 21/0008* (2013.01); *C06B 21/0066* (2013.01); *C06B 21/0091* (2013.01)

(58) Field of Classification Search
None
See application file for complete search history.

(56) References Cited

U.S. PATENT DOCUMENTS

| | | | | |
|---|---|---|---|---|
| 3,014,246 | A | 12/1961 | Cook et al. | |
| 3,702,353 | A * | 11/1972 | Henderson | C06B 21/0066 149/100 |
| 3,892,610 | A | 7/1975 | Huzinec | |
| 2004/0152788 | A1 | 8/2004 | Oga | |
| 2004/0156911 | A1 | 8/2004 | Chattopadhyay et al. | |

(Continued)

FOREIGN PATENT DOCUMENTS

| | | | |
|---|---|---|---|
| DE | 4126981 | C1 | 1/1993 |
| EP | 0481892 | A1 | 4/1992 |
| EP | 0528201 | A2 | 2/1993 |

(Continued)

OTHER PUBLICATIONS

PCT Search Report for PCT Appl No. PCT/GB2012/053059, dtd Jul. 30, 2013, 3 pages.

(Continued)

*Primary Examiner* — Aileen B Felton
(74) *Attorney, Agent, or Firm* — Maine Cernota & Rardin

(57) ABSTRACT

The invention relates to a method of producing a range of particulate energetic materials with tailored particle sizes and extremely narrow particle size distributions. The use of membrane emulsification apparatus provides a means of formulating explosives with a selectable particle size, without the use of milling techniques to physically reduce the size of the particulates.

20 Claims, 6 Drawing Sheets

(56) References Cited

U.S. PATENT DOCUMENTS

| | | | |
|---|---|---|---|
| 2006/0128815 | A1 | 6/2006 | Clare |
| 2011/0171104 | A1 | 7/2011 | Muscatelli et al. |

FOREIGN PATENT DOCUMENTS

| | | | |
|---|---|---|---|
| EP | 1382384 | A1 | 1/2004 |
| EP | 1498174 | A1 | 1/2005 |
| GB | 2123308 | A | 2/1984 |
| GB | 2133784 | A | 8/1984 |
| GB | 2467925 | A | 8/2010 |
| WO | 0145830 | A1 | 6/2001 |
| WO | 2006046200 | A1 | 5/2006 |

OTHER PUBLICATIONS

GB Search Report for GB Appl. No. 1122153.8, dtd Apr. 20, 2012, 7 pages.

"Yuan Q et al: ""Innovations in high throughput manufacturing of uniform emulsions and capsules"". Advanced Powder Technology Nov. 2010 Elsevier NLD, vol. 21. No. 6. Nov. 2010. pp. 599-608."

* cited by examiner

PROCESSING EXPLOSIVES

RELATED APPLICATIONS

This application is a U.S. National Phase Application filed under 35 USC 371 of PCT Application No. PCT/GB2012/053059, filed 7 Dec. 2012, which claims the benefit of GB Applications No. 1122153.8, filed 22 Dec. 2011. Each of these applications is herein incorporated by reference in their entirety for all purposes.

The following invention relates to methods of producing particulate energetic material compositions with tailored particle sizes, particularly particulate energetic material compositions with substantially mono-sized, narrow particle size distributions.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

According to a first aspect of the invention there is provided a method of providing an energetic material composition with a narrow particulate size distribution, comprising the steps of;

forming a dispersed phase, comprising at least one first solvent wherein at least one energetic material is dissolved therein, forming a continuous phase, comprising at least one second solvent which is substantially immiscible with said dispersed phase, causing a forming droplet of said dispersed phase to be furnished in said continuous phase, wherein a shear force is exerted on the forming droplet of dispersed phase material, to furnish a droplet, optionally causing removal of the at least one first solvent to cause precipitation of said energetic material composition in the continuous phase.

The dispersed phase comprises at least one first solvent in which the energetic material is dissolved. The first solvent will typically be selected to allow dissolution of a significant concentration (typically >5% w/v) of the energetic material. It will be clear to the skilled person that energetic materials that are soluble in organic solvents may have their at least one first solvent as an organic solvent, and the continuous phase may be selected from a polar solvent, preferably an aqueous solvent. Similarly for energetic materials that are present as salts, or are soluble in polar or aqueous solvent systems, the at least one first solvent may be selected from a polar, or aqueous system and the continuous phase solvent will be a substantially non polar organic system.

The dispersed phase may comprise stabilisers, polymers, binders, energetic binders, and crystal habit modifiers. The stabilisers may facilitate the formation of stable emulsions, such that the formed droplets remain intact. The energetic material composition may be an energetic material or may comprise further additives. The use of polymers, in the dispersed phase, may provide the energetic material with a surface coating. The use of surface coatings in the field of energetic materials is known, and provides means of reducing sensitivities, aids for binding or processing the energetic material, or providing resistance to moisture or chemical degradation. The incorporation of such polymers or binders etc, within the dispersed phase allows for the coating to be applied to the surface of the formed particulate of energetic material without further processing steps.

The continuous phase's at least one second solvent is selected such that it is largely immiscible with the at least one first solvent in the dispersed phase. The continuous phase may contain at least one stabiliser and/or at least one surfactant to facilitate the production of a stable emulsion. Additives such as crystal habit modifiers may also be added to the continuous phase.

In a preferred arrangement the continuous phase comprises an aliquot of the first solvent, to prevent premature precipitation of particulates of energetic material of said newly formed emulsion, yet more preferably there is pre-saturation of the continuous phase with the at least one first solvent.

The means of causing a forming droplet of dispersed phase (for subsequent release into the continuous phase), may be caused by any known technique, such as, for example by passing the dispersed phase via a micro porous membrane or microcavity structure, preferably there is a membrane separating the dispersed phase and continuous phase.

The porous membrane may be selected from any material, preferably the membrane has a regular pore size, preferably a machined membrane with defined through-hole diameters and regular spacing between each through hole. The membrane may be prepared from any explosively compatible material, such as, for example metals, metal alloys, polymers, ceramics. The porous membrane has a first surface which is in contact with the dispersed phase and a second surface which is in contact with the continuous phase. The porous membrane may be static or movable. A static membrane may be a simple disc through which the dispersed phase is caused to flow. In a further embodiment the membrane may comprise part of a dispensing system, which is movable in relation to one or both of the dispersing phase and/or continuous phase. The movement of the dispensing system comprising the porous membrane may provide the shear force.

The membranes may comprise a hydrophobic or hydrophilic surface coating depending on whether water in oil (W/O) or oil in water (O/W) emulsions are to be prepared. The coatings may assist in the formation of the forming droplets and their concomitant release from the second surface of the porous membrane. The pore sizes may be selected to provide the preferred final size of particulate of energetic material to achieve final average sizes of particulates of energetic material between 1 to 100 microns, the pore sizes of the membrane are preferably greater than 5 microns, preferably in the range of 20 to 50 microns.

Preferably the membrane or microcavity is prepared, i.e. wetted, by drawing aliquots of the continuous phase through the pores so as to coat the inner surfaces of the microcavity or membrane with a very thin film of the continuous phase, prior to passing the dispersed phase through the membrane or microcavity.

As the dispersed phase is caused to be passed through the membrane forming droplets are furnished on the second surface, which second surface is in contact with the continuous phase. The causing of the dispersed phase to be passed through a porous membrane or microcavity into the continuous phase, may be performed under gravity or more preferably under pressure, such as, for example by action via a pump or piston.

Where the membrane or microcavity is static, the continuous phase is caused to exert a shear force on said forming droplets of the dispersed phase that have passed through the membrane or microcavity. The shear force facilitates the removal of the forming droplet from the membrane or microcavity, with a constant force. The shear force is controlled and hence the controlled force permits controlled cleavage of the forming droplet with uniform and highly reproducible size, from the membrane or microcavity. The diameter of the final formed droplet determines the average particle size of the final particulate of energetic material.

For a given dispersed/continuous phase system, the degree of shear force applied, the applied pressure of the dispersed phase and the membrane pore or microcavity size helps to determine the final diameter of the droplets of the dispersed phase.

The action of causing the exertion of a shear force on the forming droplet may be achieved by rapidly moving the continuous phase in relation to a static membrane. A further means of causing a shear force may be causing the membrane (optionally forming part of a dispensing system for the dispersed phase) to move, such that the action of the membrane causes a shear force on the forming droplets, in a substantially static continuous phase. The shear force may be provided by any known means, such as, for example, stirring (i.e. rotation), agitation (such as, for example, oscillation), ultrasound or high pressure flow directly over the second surface of the porous membrane or microcavity. Rotation and agitation may be afforded by use of an externally powered rotating paddle, blade or bead to cause the continuous phase to be moved in a stirred or agitated fashion. In a further arrangement there may be a dispensing system, as defined hereinbefore, which comprises the dispersed phase, such that the dispensing system moves, i.e. rotates, agitates or oscillates, causing a shear force to be exerted between the substantially stationary continuous phase and the dispensing system, releasing the dispersed phase from the dispensing system into a substantially static continuous phase. The dispersed phase and continuous phases may both be processed such that they both are able to exert a shear force, such that both phases move or flow with respect to each other to create an enhanced shear force. Particular examples of membrane emulsification apparatus may be cross-flow, oscillating membrane, and microfluidic cells.

After droplets of the dispersed phase have been furnished in the continuous phase, they may be retained as an emulsion for processing at a later period in time. The droplets, at the desired time, may be caused to be precipitated from said dispersed phase to provide the particulates of energetic material. The process may be part of a batch process such that droplets are processed in the reaction vessel, or the process may be a continuous process such that the emulsion is subsequently removed from the reaction vessel for processing in a remote reaction vessel, and subsequently caused to be precipitated from said dispersed phase to provide the particulates of energetic material.

The droplets of dispersed phase are caused to form a solid particulate or suspension, by removal of the at least one first solvent. The addition of further aliquots of the continuous phase, or the at least one second solvent or a further anti-solvent, (essentially the addition of a solvent in which the particulate of energetic material (is largely insoluble) allows a more controllable rate of evaporation (as it is pre-saturated), of the at least one first solvent. Furthermore, the addition of further aliquots of said second solvent help draw the at least one first solvent out of the droplets into the continuous phase before it evaporates to the air.

It may be desirable to aid removal of the first solvent from the dispersed phase under reduced pressure and optionally at an elevated temperature.

The process as defined herein allows the production of energetic material compositions with a selected and controlled particle size range of the energetic material, typically a mono-size particulate distribution range. The control of particle size for an energetic material composition is particularly important as the size can determine the burn rate and ballistic performance of an energetic composition. The ability to produce materials with different but well defined particle sizes, mono-sized particulates, may allow energetic formulations to be more effectively filled, thus further improving performance of an energetic composition.

The membrane emulsification technique as defined herein provides energetic material composition emulsions with narrow droplet size distributions, so as to allow uniform and narrow size ranges of particulates of energetic materials.

The synthesis and formulation of energetic materials, are typically hazardous, particularly as the prior art means of creating smaller particle sizes are generally through physical techniques, such as for example milling energetic materials which are in a dry powdered form. The process according to the invention reduces the risks associated with energetic material handling, as the energetic material is dissolved, reducing the risks associated with handling the solid energetic material (e.g. friction, impact, electrostatic discharge sensitivity). Even after the particles have been generated, they may remain suspended as an emulsion in the continuous phase until isolation and subsequent drying steps.

The morphology of the particulate of energetic material may also be controlled by the appropriate selection of the evaporation conditions of said at least one first solvent, such as, for example, the rate of evaporation, and through the choice of stabilisers and additives, such as, for example crystal habit modifiers, which may be present in either the dispersed or continuous phases. The morphology of the particulates of energetic materials is known to have an effect on the sensitivity of the bulk energetic material, therefore the ability to determine and control the morphology may improve the hazard properties of the energetic materials. The morphology of the particulates of the energetic material affects the ease of handling and subsequent processing. Particulates of energetic materials with unsuitable morphology are known to produce mixtures with too high viscosity, which prevents successful cast curing of said energetic material.

According to a further aspect of the invention there is provided the use of membrane emulsification for providing substantially mono-sized particulates, comprising the steps forming a dispersed phase, comprising at least one first solvent wherein at least one energetic material is dissolved therein, forming a continuous phase, comprising at least one second solvent which is immiscible with said first solvent, causing the dispersed phase to be passed through a porous membrane into the continuous phase, wherein said continuous phase is caused to exert a shear force on said dispersed phase, separating the dispersed and continuous phases, optionally removing the first solvent from the dispersed phase to provide the energetic material.

According to a further aspect of the invention there is provided apparatus for carrying out the process according to the invention, wherein the apparatus is modified for explosive compatibility.

According to a further aspect of the invention there is provided an energetic material composition obtainable by the process defined herein.

EXPERIMENTAL

Table 1 below shows the dispersion and continuous phase solvents and additives for the preparation of energetic material particulates of four common energetic materials, nitrocellulose (NC), RDX (1,3,5-Trinitroperhydro-1,3,5-triazine), Ammonium perchlorate (AP) and ammonium dinitramide (ADN.).

TABLE 1

| Energetic material | Composition: Disperse phase | Composition: Continuous phase | Surfactant/ stabiliser |
|---|---|---|---|
| NC | 8% w/v water wet NC/ethyl acetate solution | 7.5% v/v aqueous ethyl acetate + surfactants | PVA 1% w/v SDS 1% w/v |
| RDX | 6% w/v RDX/ acetone solution | Acetone (4.15 wt %), PVA (1.05 wt %) in saturated $CaCl_2$ (aq) | PVA 1.05 wt % |
| AP | 15% w/v aqueous AP | 13% v/v $CH_2Cl_2$/kerosene solution + 1% w/v SPAN 20 | 1% w/v SPAN 20 |
| ADN | 50% w/v aqueous ADN | 13% v/v $CH_2Cl_2$/kerosene solution + 1% w/v SPAN 20 | 1% w/v SPAN 20 |

Experimental Set Up

The apparatus comprised a dispersion cell comprising a membrane and a stirring paddle, a variable electrical power supply to vary the rotational speed of the paddle and hence vary the shear force of the continuous phase on the forming droplet, and a syringe pump to introduce the dispersed phase through the membrane located in the dispersion cell.

A syringe pump was selected owing to the small volumes used, and the ability to precisely control the flow rate. A second, smaller syringe was connected to the line supplying the dispersed phase, connected via a 3 way tap to allow a small quantity of the continuous phase to be drawn back through the membrane (wetting) prior to a run. This wetting operation ensures the complete wetting of the membrane pores with the continuous phase. The dispersion cell consists of the membrane located in a membrane housing at the base of the vessel, an emulsification chamber containing the continuous phase of the emulsion, and a paddle stirrer located in the continuous phase to provide the shear forces responsible for partial control of the dimensions of the forming droplet. As the dispersed phase is pumped into the dispersion cell, it passes through the membrane, and forming droplets are sheared off the membrane surface by the movement of the continuous phase over the surface of the membrane exerting a shear force on the forming droplets. The paddle stirrer is controlled by a variable voltage power supply. In this way, precisely controlled shear forces may be created within the emulsification chamber.

The membrane used was a metallic foil type, with regularly spaced circular pores of a defined size, 15, 20, 30, 50, and 100 micron hole sizes were used.

Experiment 1

NC and RDX

The emulsions were prepared according to the condition set out in Table 1, above. The dispersed phase (30 ml) was drawn up in a syringe and loaded into the syringe pump. The syringe pump was connected to the dispersion cell which was fitted with a membrane with a hydrophilic surface coating, and pore size (starting from 20 μm). The dispersion cell was charged with the continuous phase (130 ml). The paddle stirrer was switched on before the introduction of materials to remove any trapped air bubbles from the membrane surface the continuous phase.

A small quantity of continuous phase was drawn back through the membrane to ensure thorough wetting of the pores of the membrane. The syringe pump was activated and fed the dispersed phase into the dispersion cell via the membrane. All experiments in this study used a flow rate of dispersed phase of 2 ml/minute.

The experiment was repeated with a range of voltages (i.e. range of shear forces) and a range of membrane pore sizes.

After all of the dispersed phase had been passed through the dispersion cell, the emulsion was collected for generation of particulates.

The particulate materials NC and RDX, were then removed from their respective emulsions by different techniques.

Experiment 2

Particle Generation from NC Emulsions

The NC emulsion was stirred at a slower rate than the initial emulsion formation, a further quantity of continuous phase (150 ml) was added to the dispersion cell. The addition was to allow the evaporation of ethyl acetate to take place over a longer period of time. Water (150 ml) was added to the stirred mixture at the rate of 2 ml/minute. After stirring for a further 18 hours at ambient temperature, the NC particulates precipitated out of solution, and were subsequently collected by filtration and washed with water (3×50 ml). The particulate NC was stored as a water wet sample. The samples may then optionally be dried in a desiccated vacuum oven, before further processing.

Experiment 3

Particle Generation from RDX Emulsions

The emulsion was stirred for 18 h at ambient temperature. After this time, water (50 ml) was added (to dissolve any precipitated $CaCl_2$) and the mixture was stirred for a further 45 minutes. After this time the mixture was washed with water (3×50 ml), using a centrifuge to allow decanting of the wash water. The RDX material was separated from the final water wash by filtration. The RDX was dried at ambient temperature in a desiccated vacuum oven.

Experiment 4

Particle Generation from AP Emulsions

The AP emulsion was formed using the reverse phase to those used for Experiments 1 to 3, namely the dispersed phase is an aqueous phase and the continuous phase is a non-polar i.e. organic solvent. A hydrophobic membrane having 15μ pore size was used.

The removal of water from the emulsion was achieved under reduced pressure, using a standard laboratory rotary evaporator and vacuum pump. The maximum temperature used in the heating bath for this operation was 60° C. After removal of all the water, the suspension of AP particles was allowed to settle for 40 minutes. The majority of the continuous phase was then decanted, and the AP washed with dichloromethane (3×50 ml). The material was separated from the final wash by filtration. The AP was dried at ambient temperature in a desiccated vacuum oven.

Experiment 5

Particle Generation from ADN Emulsions

The ADN emulsion was formed using the reverse phase to those used for Experiments 1 to 3, namely the dispersed phase is an aqueous phase and the continuous phase is a non-polar i.e. organic solvent. A hydrophobic membrane having 15μ pore size was used.

The removal of water from the emulsion was achieved under reduced pressure, using a standard laboratory rotary evaporator and vacuum pump, elevated temperatures, after all the water had been removed the suspension of ADN was filtered and washed with dichloromethane (2×50 ml) and hexane (1×50 ml). The sample was dried at ambient temperature in a desiccated vacuum oven.

Analysis of Results

Microscope analysis of the particulate materials was undertaken using a Reichert Jung MeF3 instrument at magnifications of 100, 400 and 1000×. An Olympus B2 microscope was used for the examination of emulsions.

Particle size distribution measurements were conducted using a Malvern 2000 Mastersizer laser diffraction instrument. Nitrocellulose and RDX samples were dispersed in water, whilst ammonium perchlorate samples were dispersed in liquid paraffin.

Turning to FIG. 5, shows the graph of particle size distribution of NC, using different pore sizes of porous membrane with a fixed level of shear force. The fixed shear force was achieved by a constant stir rate by applying 6 V to the electric motor driving the paddle. The particle distribution is bimodal with very narrow distribution centred within the desired particle range, namely between 10 and 100 microns.

FIG. 6, shows the graph of particle size distribution using fixed pore size of porous membrane with variable shear forces applied. As can be seen, with careful selection of the shear force the secondary particulate size can be significantly reduced, in this case with 12V applied to the motor, the distribution is substantially mono-sized, with the exception of a few fines, i.e. material which may have been caused by handling the material after drying.

The images in FIGS. 7*a* and 7*b* show the near spherical NC particulates formed by the process. The size of the shear force in the membrane cell was found to have a strong influence on the size of the material obtained, whilst for this particular experimental set up, the membrane pore size employed was found to have little influence of the particle size of the material obtained. The reproducibility of the particle size of each particulate gives rise to reduced variation between subsequent batches of material, and hence a more desirable product.

The graph in FIG. 8, shows the distributions for RDX, AP and NC. It has been shown that with only minor optimisation of the experimental conditions, that very narrow particle size ranges of energetic particulate materials can be provided.

Commercially available ADN, as shown in FIG. 9, contains a wide particle size range. There are a wide range of particulate geometries and particulate sizes, such as, for example, elongate crystals, spheres, and fines (very small particulates). FIG. 10, shows that after the commercially available ADN has been subjected to methods of the invention, the particulates are very uniform in size. The graph in FIG. 11, confirms that the ADN prepared according to the invention has a very narrow particulate size range.

The particulate energetic materials were assessed for levels of impurities, only low levels of contaminants are present in the particulate materials after the membrane emulsification procedure.

As mentioned earlier, the sensitiveness of energetic materials are affected by their morphology. The particulates of energetic material prepared according to the invention where subjected to hazard testing such as impact and friction, and it was subsequently found that the hazard was not increased as a result of the membrane emulsification process. The RDX material advantageously showed a reduction in the sensitiveness of the material compared to the pre-processed material.

An embodiment of the invention will now be described by way of example only and with reference to the accompanying drawings of which:

Figure 7A:
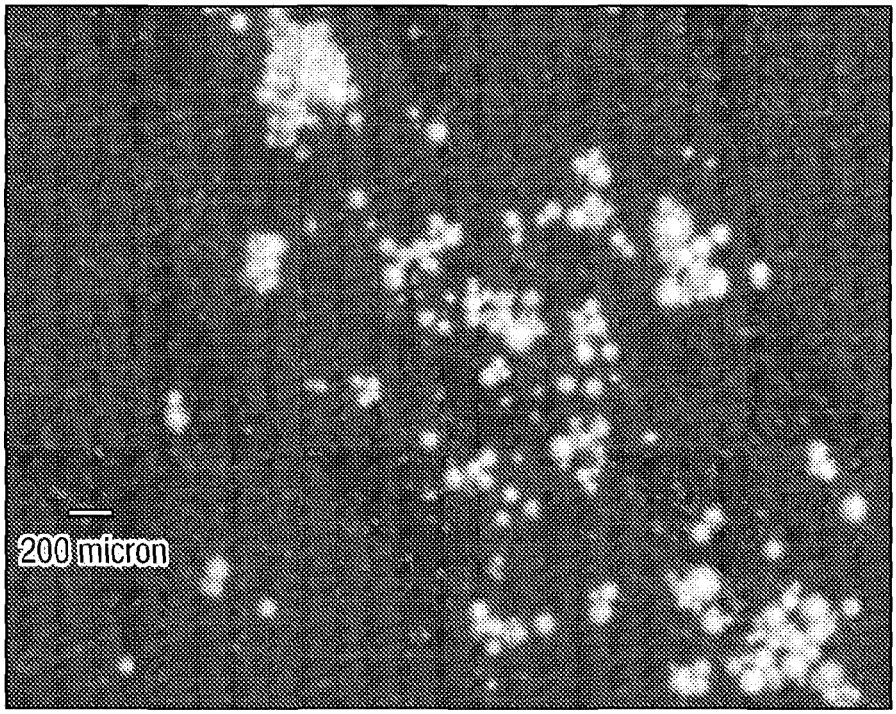
Figure 7B:
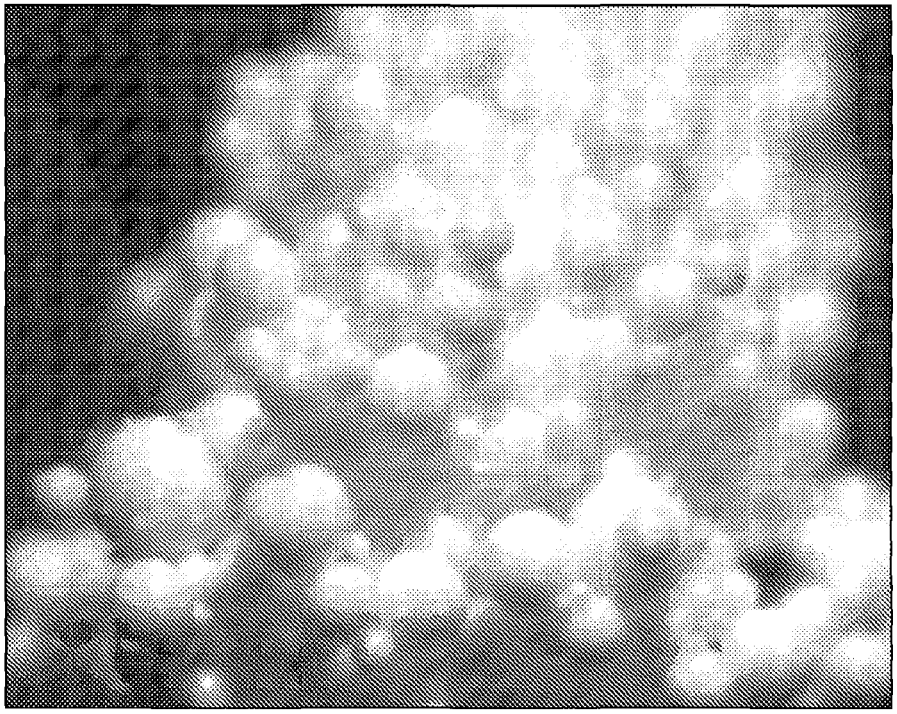

FIGS. 7*a* and 7*b* show images of the particles sizes of NC

Figure 8:
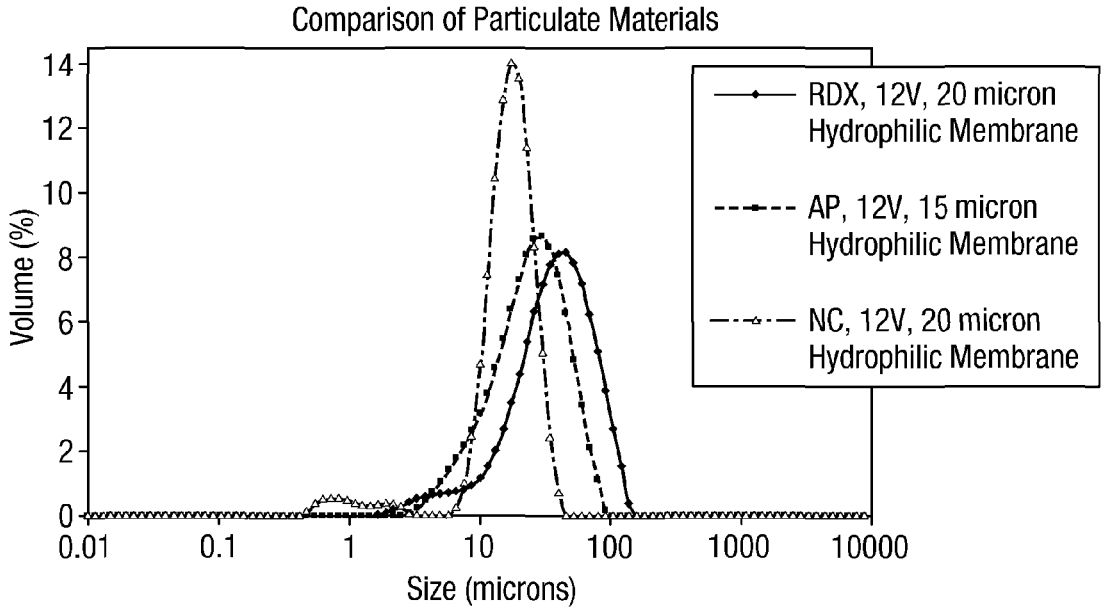

FIG. 8 shows a graph of particle size distribution of NC, RDX, and AP.

Figure 9:
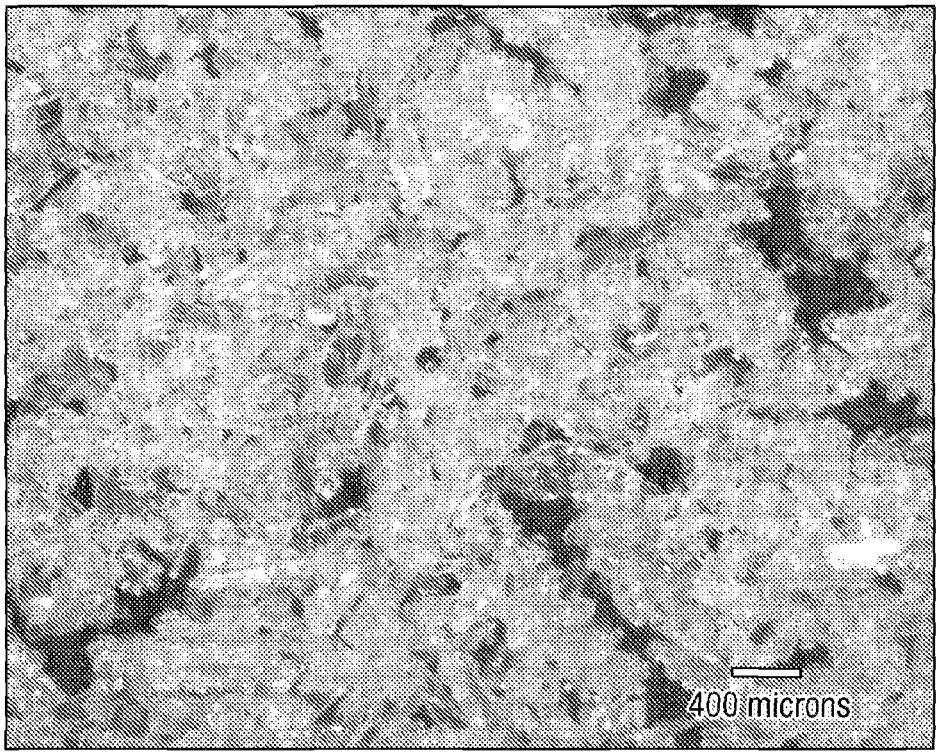

FIG. 9 show images of the particles sizes of commercially available ADN

Figure 10:
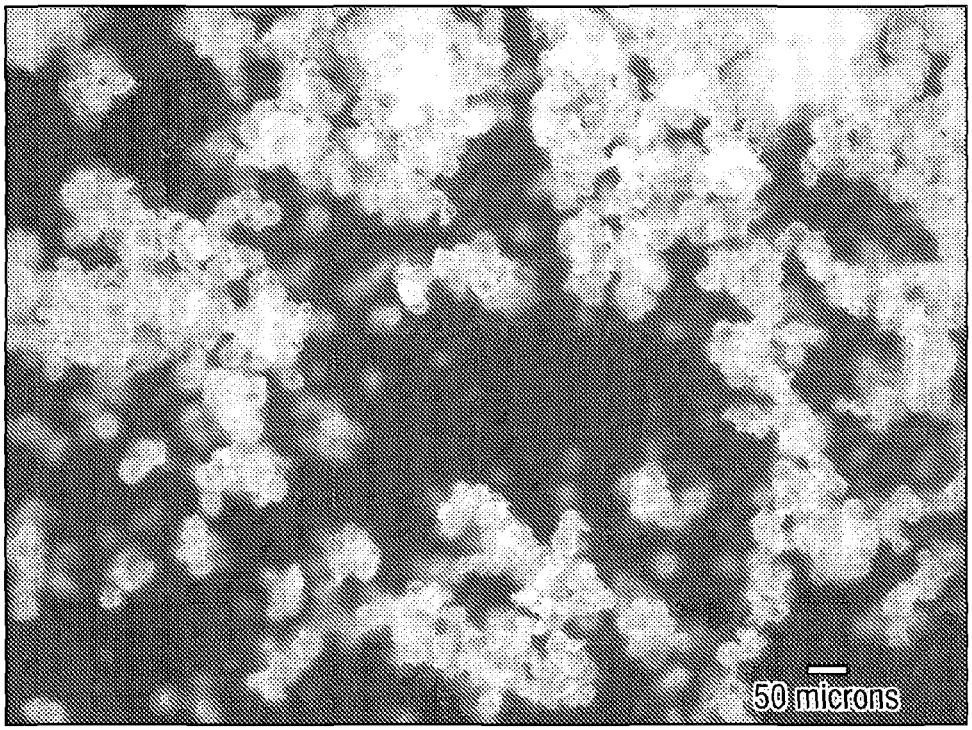

FIG. 10 show images of the particles sizes of ADN prepared according to the invention.

Figure 11:
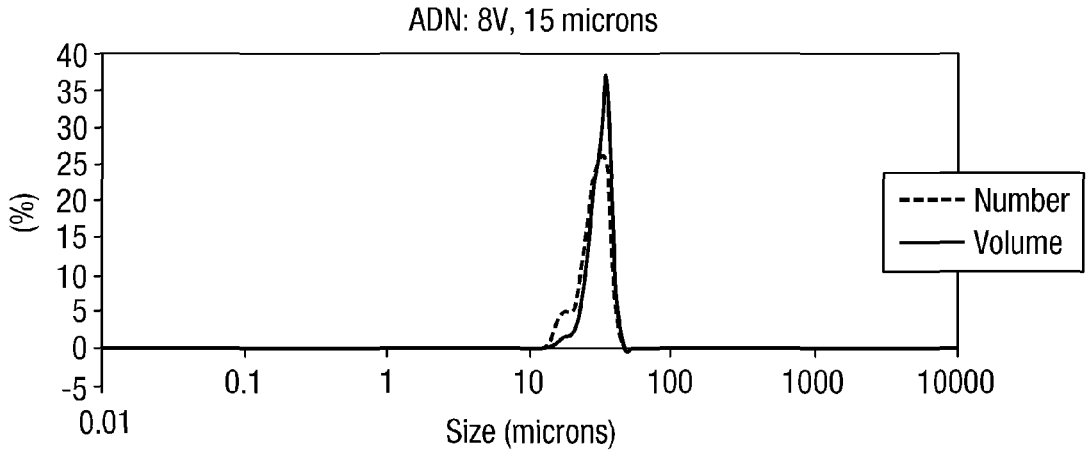

FIG. 11 shows a graph of particle size distribution of ADN at a fixed shear and membrane pore size.

Figure 1:
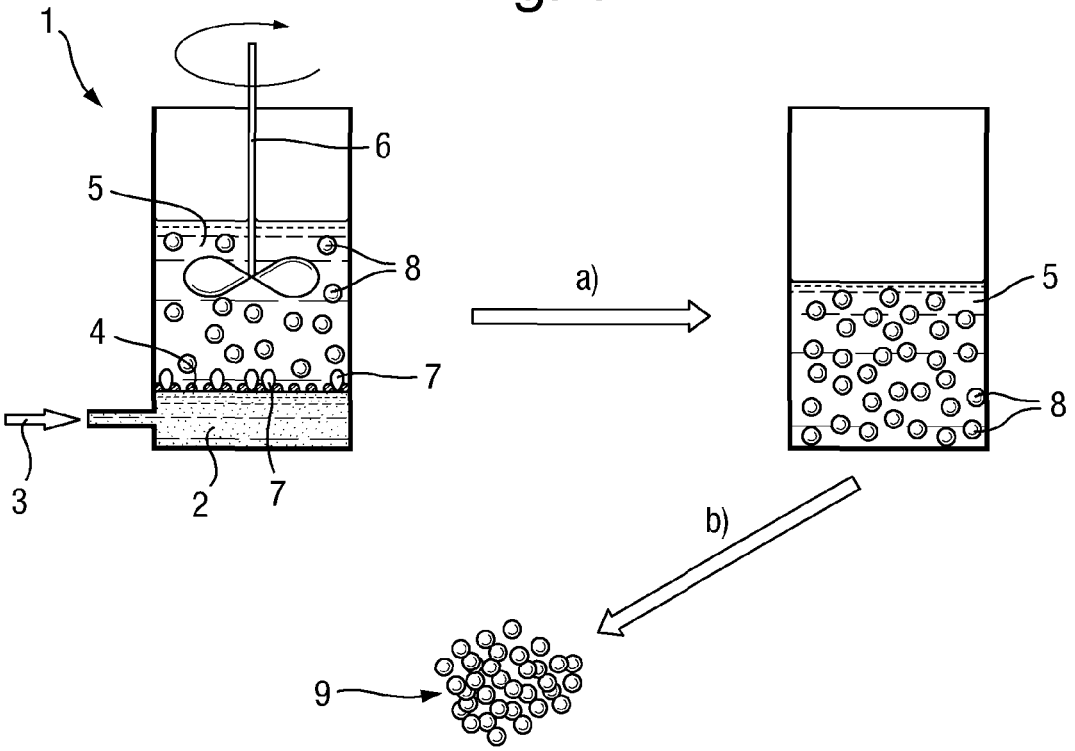
FIG. 1 shows experimental set up of membrane emulsification

Turning to FIG. 1 there is provided membrane emulsification apparatus 1, comprising a cell 2, which comprises a chamber comprising the continuous phase 5, which is separated from the dispersed phase 3 by membrane 4. The continuous phase 5 is stirred by a paddle 6 powered by an electric motor (not shown). The stirring causes a shear force to be set up at the face of the membrane 4, such that forming droplets 7 of the dispersed phase (which contains the dissolved energetic material), may be cleaved by the shear force to form droplets 8.

After all of the dispersed phase 3 has been passed through the membrane, process step a), involves removal of the first solvent of the dispersed phase 3, to ultimately allow precipitation of the energetic particulate 9. It may be desirable to add further aliquots of the continuous phase to cause slower evaporation of the precipitation of the energetic particulate 9 from dissolved droplet 8. The slower evaporation can help to control the type of crystal or solid formed therein. Process step b) then requires filtration to remove the particulates 9 from the supernatant liquid.

If the process is a simple lab scale batch process then the reaction vessel 1 may be used to carry out all steps of the process, namely preparation of the droplets 8, and then the solidification of the dissolved material.

Alternatively if the process is a production scale arrangement then the other techniques below may be used. In a continuous process the emulsion may be removed from reaction vessel, such that the step of solidification is carried out remotely from the main reaction vessel. Optionally the emulsion may be stored for processing at a later date.

Figure 2:
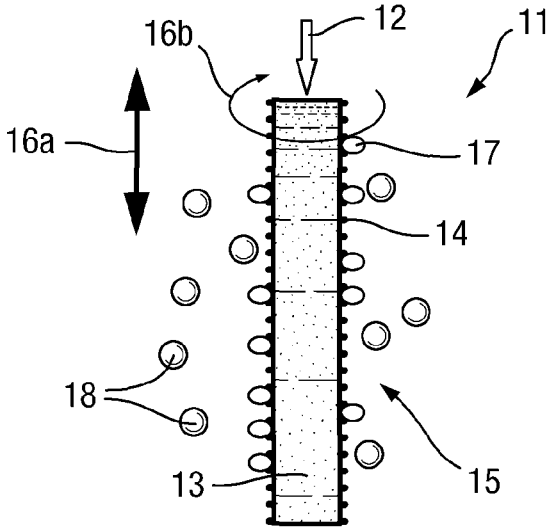
FIG. 2 shows side view of a moveable dispersing system.

FIG. 2 shows a membrane emulsification apparatus 11, comprising a dispersing system 12, which is primed with the dispersed phase (comprising the dissolved energetic material) 13. The dispensing system 12, may be rotated 16*b*, or oscillated 16*a*, to provide a shear force between the dispersed phase 13 and the continuous phase 15. During movement of system 12, the shear force removes forming droplets 17, of the dispersed phase material 13 at the membrane surface 14. The droplets 18 may then be processed in a similar manner to that in FIG. 1.

Figure 3:
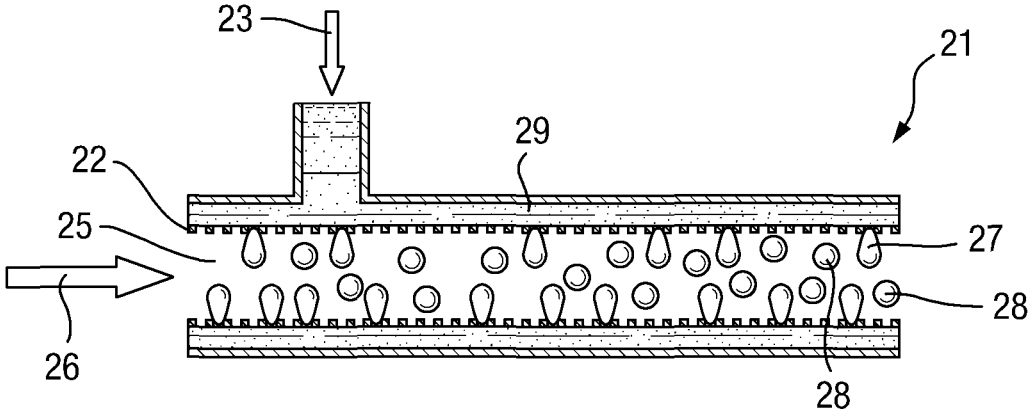
FIG. 3 shows a side view of flow cell arrangement

FIG. 3 provides a cross-flow membrane cell 21, wherein the wall chamber 29 is fitted with a membrane surface 22. The chamber 29 is charged with the dispersed phase 23. The continuous phase 25 is forced under pressure to flow 26 over the surface of the membrane, wherein said flow 26 creates a shear force to remove said forming droplets 27 from the surface of the membrane 22, to form droplets 28.

Figure 4:
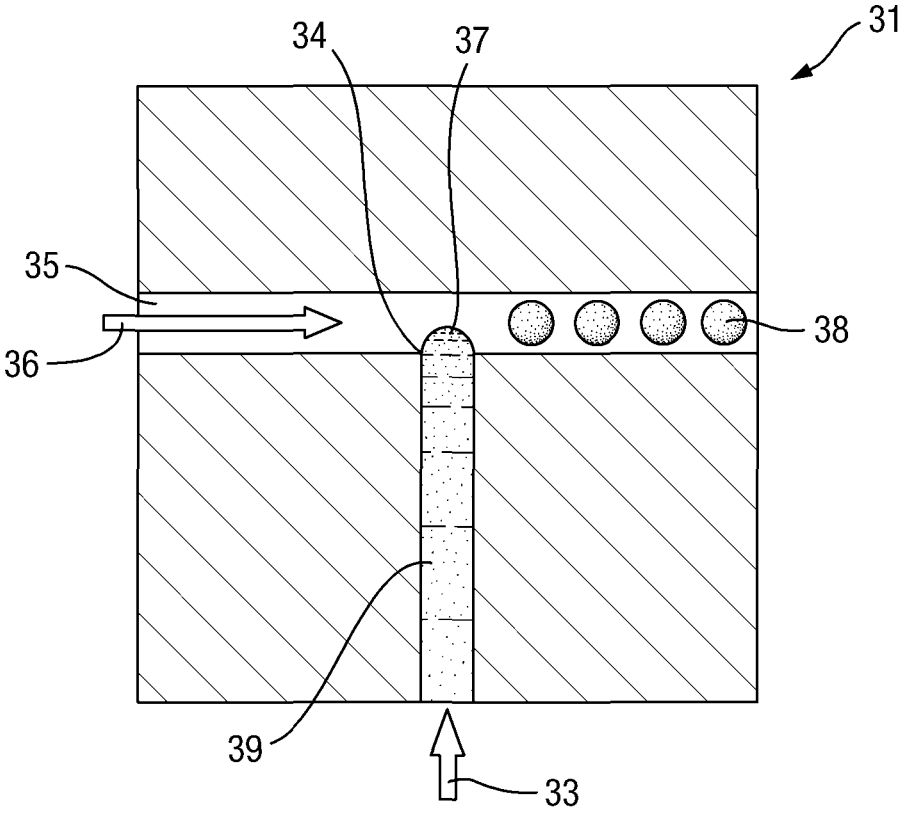
FIG. 4 shows a side view of a micro fluidic cell arrangement.

FIG. 4 provides a microfluidic flow cell 31, wherein there is a plurality of said microcavities 39, wherein each microcavity 39 is acts as an elongate membrane pore, the surface of said microcavity 34 provides the forming droplet 37. The chamber 39 is charged with the dispersed phase 33. The continuous phase 35 is forced under pressure to flow 36 over the surface of the microcavity surface 34, wherein said flow 36 creates a shear force to remove said forming droplets 37 from the surface 34, to provide droplets 38, in a similar fashion to that shown in FIG. 3.

Figure 5:
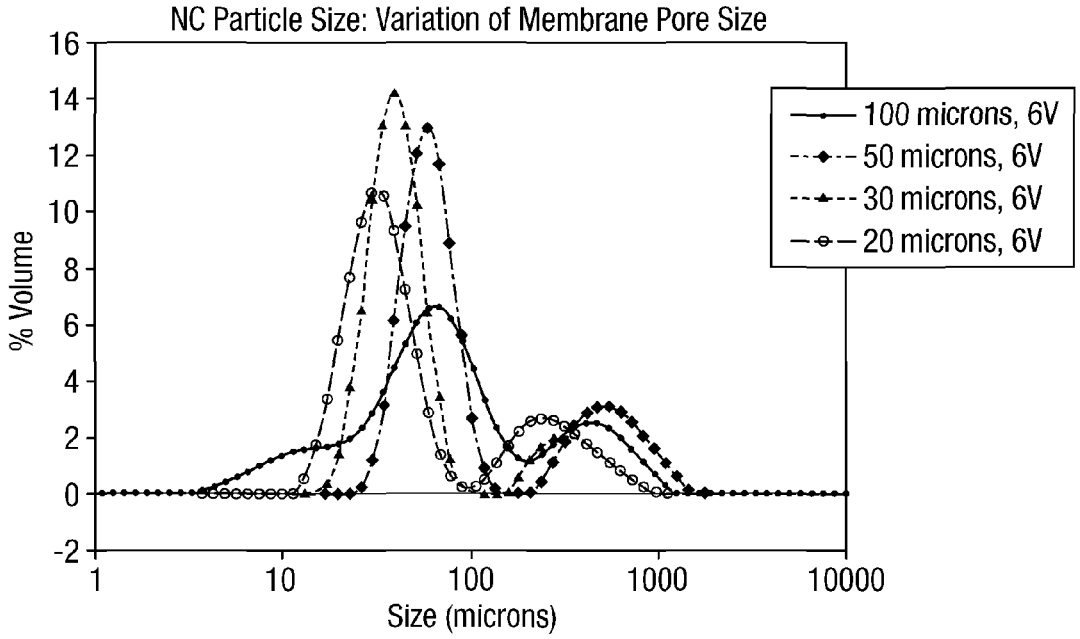
FIG. 5 shows a graph of particle size distribution of NC with variation of membrane pore size
Figure 6:
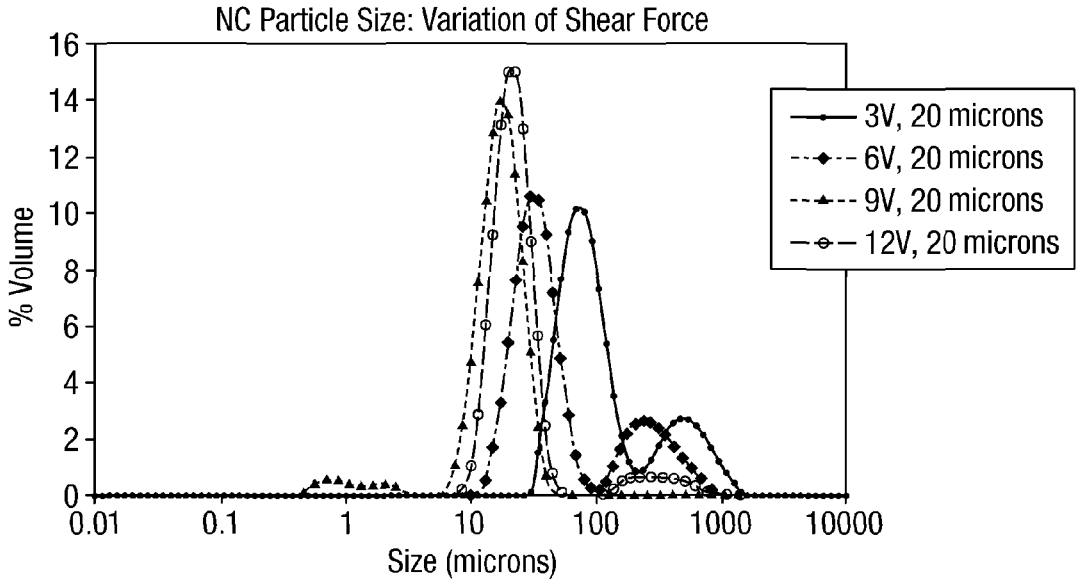
FIG. 6 shows a graph of particle size distribution of NC with variation of shear force.

FIGS. 5, 6 are graphs of the particle size distributions which are discussed in the analysis section above.

FIG. 7*a* and *b* shows a photograph of spheres of nitrocellulose taken through a microscope at ×20 and ×80 magnification respectively.

FIG. 8 is a graph of the particle size distributions which are discussed in the analysis section above.

FIGS. 9 and 10 show photographs of commercially available ADN and the same ADN processed according to the methods defined herein, respectively.

FIG. 11 shows a graph of particle size distribution of ADN at a fixed shear and membrane pore size.

The invention claimed is:

1. A method of providing an energetic material composition with a narrow particulate size distribution, the method comprising:

forming a dispersed phase, comprising at least one first solvent wherein at least one energetic material is dissolved therein;

forming a continuous phase, comprising at least one second solvent which is substantially immiscible with said dispersed phase;

passing the dispersed phase through a membrane or microcavity, thereby causing a forming droplet of said dispersed phase to be furnished in said continuous phase; and directing a flow of the continuous phase past the membrane or micro-cavity, thereby exerting a shear force on the forming droplet of dispersed phase material, to furnish a droplet.

2. The method according to claim 1, wherein the continuous phase comprises an aliquot of the first solvent, to prevent premature precipitation of particulates of said newly formed emulsion.

3. The method according to claim 2, wherein there is presaturation of the continuous phase with the first solvent.

4. The method according to claim 1, wherein the membrane or microcavity structure is initially wetted with an aliquot of the continuous phase.

5. The method according to claim 1, where the solvent can dissolve at least 5% w/v of energetic material.

6. The method according to claim 1, wherein the continuous phase comprises surfactants, stabilisers, and crystal habit modifiers.

7. The method according to claim 1, wherein the dispersed phase comprises stabilisers, polymers, binders, energetic binders, and crystal habit modifiers.

8. The method according to claim 1, further comprising removing the first solvent from the dispersed phase under reduced pressure.

9. The method according to claim 1, wherein the method is a continuous or batch process.

10. A method of producing energetic materials with a narrow particulate size distribution, the method comprising:

forming a dispersed phase, comprising at least one first solvent wherein at least one energetic material is dissolved therein;

forming a continuous phase, comprising at least one second solvent which is substantially immiscible with said dispersed phase;

causing the dispersed phase to be passed through a porous membrane into the continuous phase, thereby forming droplets of said dispersed phase;

causing said continuous phase to flow past the membrane, thereby exerting a shear force on said droplets, and distributing said droplets in said continuous phase; and separating the dispersed and continuous phases.

11. A method for providing substantially mono-sized particulates, the method comprising:

forming a dispersed phase, comprising at least one first solvent wherein at least one energetic material is dissolved therein;

forming a continuous phase, comprising at least one second solvent which is immiscible with said first solvent;

passing the dispersed phase through a membrane or microcavity, thereby causing the dispersed phase to be formed into droplets in the continuous phase; and subjecting said droplets to a shear force caused by a flow of the continuous phase past the membrane or micro-cavity, thereby distributing the droplets in the continuous phase.

12. The method of claim 1, wherein at least one step of the method is carried out in an apparatus that is modified for explosive compatibility.

13. The method of claim 1, further comprising removing the at least one first solvent to cause precipitation of said energetic material composition in the continuous phase.

14. The method of claim 10, wherein at least one step of the method is carried out in an apparatus that is modified for explosive compatibility.

15. The method of claim 11, wherein at least one step of the method is carried out in an apparatus that is modified for explosive compatibility.

16. The method of claim 1, wherein the membrane or micro-cavity has a pore size that is not greater than 100 microns.

17. The method of claim 10, wherein the membrane has a pore size that is not greater than 100 microns.

18. The method of claim 11, wherein the membrane or micro-cavity has a pore size that is not greater than 100 microns.

19. The method of claim 10, further comprising wetting the membrane with an aliquot of the continuous phase.

20. The method of claim 11, further comprising wetting the membrane or microcavity with an aliquot of the continuous phase.

* * * * *